US008128539B2

(12) United States Patent
Dickerson

(10) Patent No.: US 8,128,539 B2
(45) Date of Patent: Mar. 6, 2012

(54) TECHNIQUE PLATES

(76) Inventor: Mercedes L. Dickerson, Hayward, CA (US)

( * ) Notice: Subject to any disclaimer, the term of this patent is extended or adjusted under 35 U.S.C. 154(b) by 56 days.

(21) Appl. No.: 12/795,470

(22) Filed: Jun. 7, 2010

(65) Prior Publication Data

US 2010/0248913 A1 Sep. 30, 2010

Related U.S. Application Data

(63) Continuation-in-part of application No. 12/131,823, filed on Jun. 2, 2008, now abandoned.

(51) Int. Cl.
*A63B 21/072* (2006.01)
*A63B 21/06* (2006.01)

(52) U.S. Cl. ..... 482/106; 482/93

(58) Field of Classification Search ..... 482/93, 482/106–109

See application file for complete search history.

(56) References Cited

U.S. PATENT DOCUMENTS 3,226,117 A * 12/1965 Walklet ..... 482/106
5,230,684 A * 7/1993 Wallisch ..... 482/141
5,656,000 A * 8/1997 Russell ..... 482/52
5,692,996 A * 12/1997 Widerman ..... 482/93
5,853,355 A * 12/1998 Standish ..... 482/106
5,891,004 A * 4/1999 Berry ..... 482/129
6,436,015 B1 * 8/2002 Frasco et al. ..... 482/106
6,447,434 B1 * 9/2002 Waters ..... 482/140
6,520,825 B1 * 2/2003 Herr ..... 446/71
6,583,370 B2 * 6/2003 Stoneberg ..... 177/264
2005/0065001 A1 * 3/2005 Su ..... 482/106
2007/0184943 A1 * 8/2007 Davies ..... 482/93
2008/0200316 A1 * 8/2008 Shillington ..... 482/106
2009/0298654 A1 * 12/2009 Dickerson ..... 482/93

* cited by examiner

*Primary Examiner* — Allana Lewin
(74) *Attorney, Agent, or Firm* — Shook Hardy & Bacon LLP

(57) ABSTRACT

An apparatus for weightlifting. In one embodiment, the apparatus includes a plurality of technique plates. Each technique plate of the plurality of technique plates is an Olympic weightlifting technique plate. Each technique plate is formed as one piece of solid plastic-based composite, wherein a given technique plate is a different color from other technique plates of a different weight. Each technique plate has a color that is provided by the solid plastic-based composite. Each technique plate comprises a hole that is configured to receive a bar, wherein the hole of a given technique plate is rugged due in part to the given technique plate being one piece and made of solid plastic-based composite, wherein the hole of each technique plate has a hole tolerance and hole width that maintains sliding with ease and minimum teetering of the technique plate on the bar. Each technique plate is secure on the bar preventing damage to the technique plates when dropped on the floor. The plurality of technique plates being rugged, ease of use, and secure on the bar enables a user to focus on technique during weightlifting.

9 Claims, 8 Drawing Sheets

TECHNIQUE PLATES

CROSS-REFERENCE TO RELATED APPLICATIONS

This application is a Continuation-in-Part of U.S. patent application Ser. No. 12/131,823, entitled Technique Plates, filed Jun. 2, 2008.

FIELD OF THE INVENTION

The present invention relates to weightlifting systems, and more particularly to a technique plate used in a weightlifting system.

BACKGROUND OF THE INVENTION

Weightlifting systems are well known. Typically weightlifting systems include a bar with removable plates of varying weights. A weightlifter may adjust the weights by adding plates to the bar or removing plates from the bar.

In Canada, most plate sets prior to about 1970 were graduated in pounds. A changeover to metrics occurred in the early 70s due to an increased international exposure of weightlifting as well as Canada's anticipated metrification. In addition, the Russian "World Record" plate set was popular at this time and was only available in metric. The conversion to metrics occurred over a transitional period. In Olympic weightlifting oriented gyms, 45, 35, 25, 10, 5, and 2.5 pound plates; 5 pound collars; and 45 pound bars were gradually replaced with 20, 15, 10, 5, 2.5, and 1.25 kilo plates; 2.5 kilo collars; and 20 kilo bars.

The French produced the first rubber plate set in the early sixties. The first time rubber plates were used in Canada was around 1967. Rubber plates came about because they were more floor friendly. As weightlifting records increased, manufacturers found less room for plates on their bar sleeves. One solution was to decrease the width of each plate. However, this made the pressure-per-area even greater when forming plates. A rubber-iron combination plate was invented that was narrower than the old iron plates but wider and softer than the new ones. However, they were also more expensive and had a shorter life.

The size of the heaviest discs is typically 450 mm. Fifteen kilogram plates have only been full sized (diameter) since the 1960s. The Russian "World Record" plate sets had them first. Larger plates also spread the impact on more barbell surface area. There are now full-sized 10 pound plates, even some 5 and 2.5 pound plates. Twenty-five kilogram plates were also added in 1972. Four years later 50 kilogram rubber plates were added.

The barbell has not changed fundamentally since the 1928 Olympics where the revolving sleeve barbell became the standard. Attempts at standardizing the bar were made as early as around 1905, but standardization could not be finalized until the lifts were finally standardized in 1928. Only a few superficial changes have been instituted since then, such as the markings. A women's bar was added in 1996, with colors that distinguish men's bar from a women's bar in 2000.

During a number of years, it was common to use barbells without collars, whether in training or competition. This was possible due to the tight fit. The rules were changed in 1972 to require collars, where a standard two clamps were used to grip the sleeve and a revolving screw device was used to tighten the sleeve against the plates. The device worked but it was also awkward to use. So at the 1958 Brussels Worlds Fair, the Soviets introduced to the world their revolutionary new "World Record" barbell set. Its plates were made of steel instead of cast iron. The plates also were edge trimmed with chrome or stainless steel while their sides were painted blue. This made for very photogenic competition shots. The sleeves had a series of grooves that allowed a ratchet clip on the collar to catch and secure the collar into position. Slippage was then impossible, while a screw device without the usual levers could make the finer adjustments against the plates. This set remained popular until 1972. The collar system never did catch on due to the wider sleeves that were necessary. As a result, 50 mm sleeves became standard. The Soviets were somehow allowed to use a rubber version in the 1980 Olympics that was still outside the rules. In the 1972 Olympics, a barbell was used, which reverted to essentially exercise collars. These had a single screw lever that wound against the sleeve. The screw lever was very simple but fine adjustments to secure the plates were not possible.

There exists weightlifting plates that are not used for competition but are instead used for training. These types of plates are referred to hereinafter as technique plates. FIG. 1 is a diagram of conventional technique plates 10. The technique plates 10 shown are each 10 pounds and each has a 17½ inch diameter. These technique plates 10 are used for weightlifting training but are problematic because they bend. Consequently, a weightlifter cannot repeat a stable setup for lifting the weights from the floor, which is not good for learning weightlifting technique.

FIG. 2 is a diagram of other conventional technique plates 20. These technique plates 20 are made thin in order to achieve a light weight and low mass for weightlifting training. These technique plates 20 are hexagonal shaped to enable them to stand up. However, these technique plates 20 cannot be dropped, which is not good for learning weightlifting technique.

Another type of training plate used for weightlifting is called a bumper plate (not shown). As the name suggests, bumper plates have a rubber composition. The rubber helps to dampen the impact when the plate is dropped.

Bumper plates are greater than 10 kg in weight, out of the technique range, and are dropped with more force and made to couple on the bar with comparable heavy weights.

Accordingly, what is needed is an improved technique plates for training. The present invention addresses such a need.

SUMMARY OF THE INVENTION

An apparatus for weightlifting is disclosed. In one embodiment, the apparatus includes a plurality of technique plates. Each technique plate of the plurality of technique plates is an Olympic weightlifting technique plate. Each technique plate is formed as one piece of solid plastic-based composite, wherein a given technique plate is a different color from other technique plates of a different weight. Each technique plate has a color that is provided by the solid plastic-based composite. Each technique plate comprises a hole that is configured to receive a bar, wherein the hole of a given technique plate is rugged due in part to the given technique plate being one piece and made of solid plastic-based composite, wherein the hole of each technique plate has a hole tolerance and hole width that maintains sliding with ease and minimum teetering of the technique plate on the bar. Each technique plate is secure on the bar preventing damage to the technique plates or flooring when dropped on the floor. The plurality of technique plates being rugged and secure on the bar enables a user to focus on technique during weightlifting.

DETAILED DESCRIPTION OF THE INVENTION

The present invention relates to weightlifting systems, and more particularly to weightlifting system that uses a weightlifting technique plate for improving weightlifting technique. The following description is presented to enable one of ordinary skill in the art to make and use the invention, and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

A weightlifting technique plate for improving weightlifting training is disclosed. The weightlifting technique plate (also referred to herein as a "technique plate") is a plate formed as one piece of solid plastic and includes a hole that is configured to receive a bar. The technique plate is used in a weightlifting system. According to the apparatus disclosed herein, the technique plate is rugged and stable. To more particularly describe the features of the present invention, refer now to the following description in conjunction with the accompanying figures.

Figure 3:
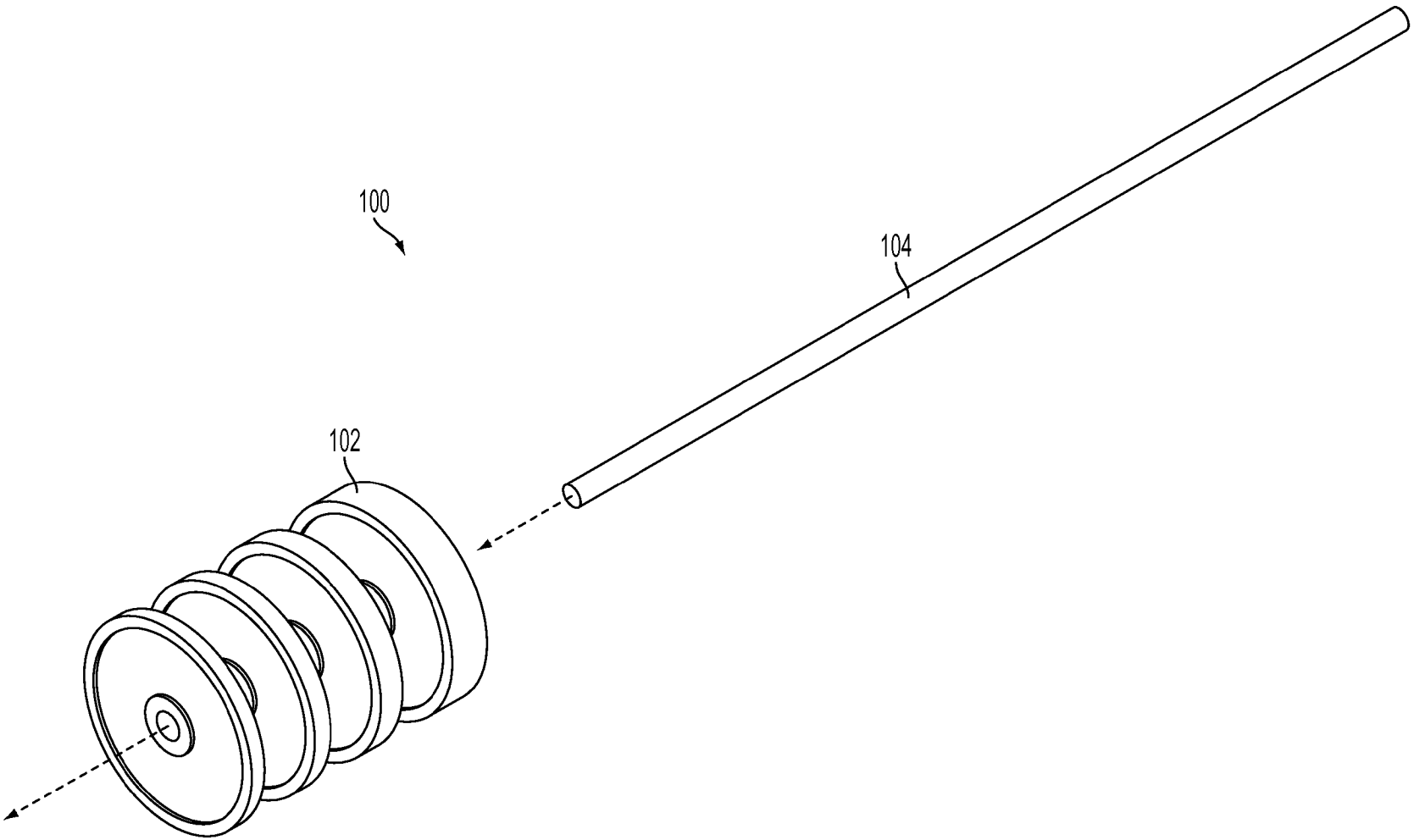
FIG. 3 is a diagram of a weightlifting system in accordance to one embodiment.

FIG. 3 is a diagram of a weightlifting system 100 in accordance to one embodiment. As FIG. 3 shows, the weightlifting system 100 includes a set of technique plates 102 and a bar 104. In one embodiment, the bar 104 is made of metal. The weightlifting system 100 is used for improving weightlifting training technique for weight lifters. In one embodiment, the each of the technique plates 102 is used for Olympic weightlifting. As such, the bar 104 may be an Olympic weightlifting barbell. In one embodiment, the technique plates 102 may be secured to the bar 104 using collars if desired.

In particular embodiments, the technique plates 102 are used as training tools in the sport of weightlifting as well as in Olympic weightlifting. As a training tool, the technique plates 102 teach the technique of weightlifting and enhance the technique of weightlifting. In one embodiment, the technique plates 102 are different from conventional weightlifting plates in that the technique plates 102 are the same size and shape as competition weightlifting plates but are lighter in weight than competition weightlifting plates. Also, as described in more detail below, the technique plates 102 are rugged and thus will not break from impact when dropped on the floor.

Figure 4:
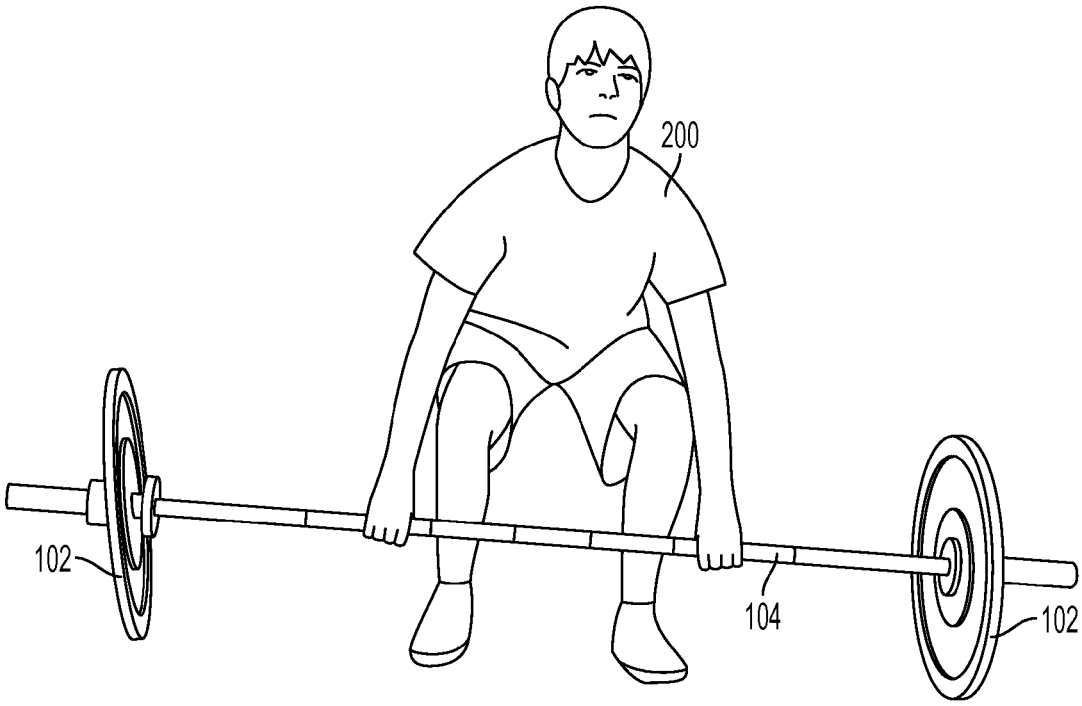
FIG. 4 is a diagram of a weightlifter at a start position just before lifting a bar with the technique plates in accordance to one embodiment.
Figure 5:
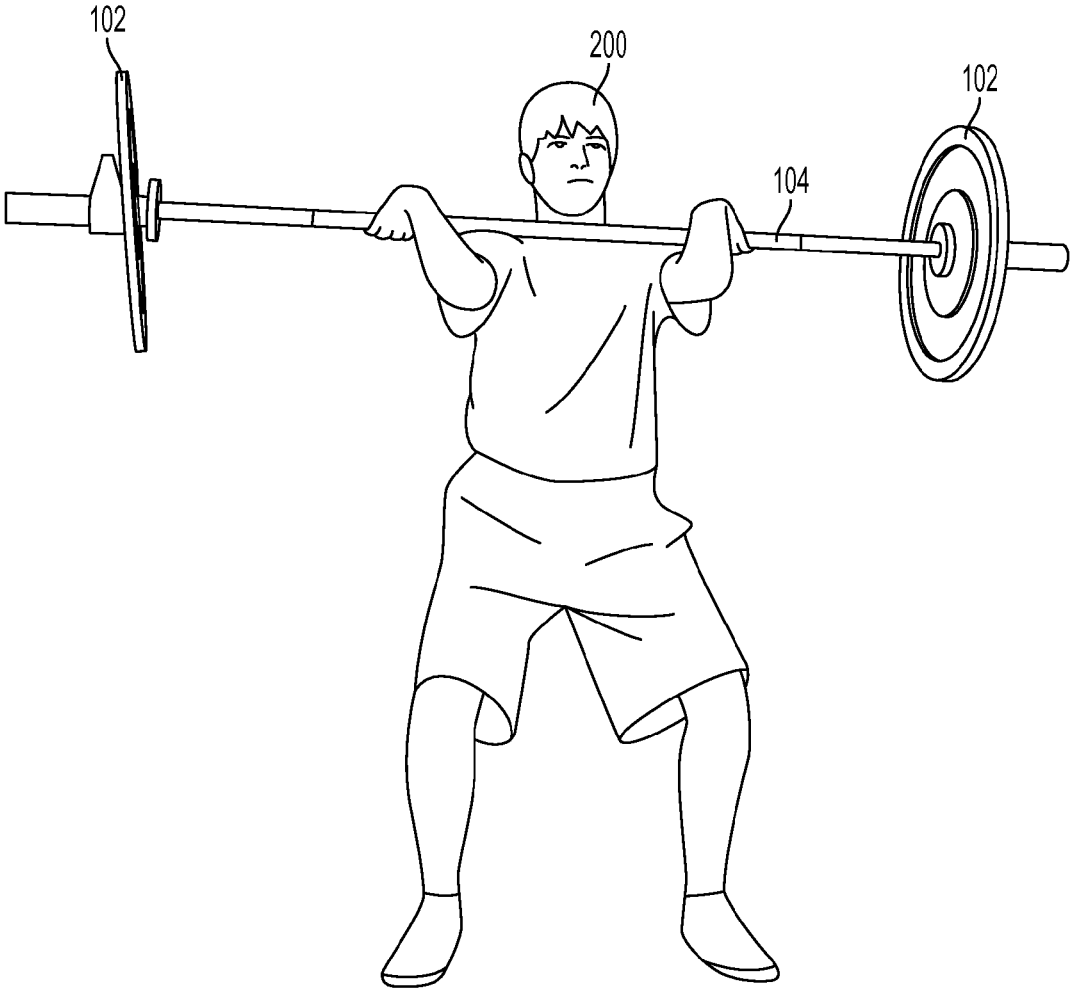
FIG. 5 is a diagram of a weightlifter at another position after lifting a bar with the technique plates in accordance to one embodiment.

FIG. 4 is a diagram of a weightlifter 200 at a start position just before lifting a bar 104 with the technique plates 102 in accordance to one embodiment. FIG. 5 is a diagram of the weightlifter 200 at a finish position after lifting the bar 104 with the technique plates 102 in accordance to one embodiment.

Figure 6:
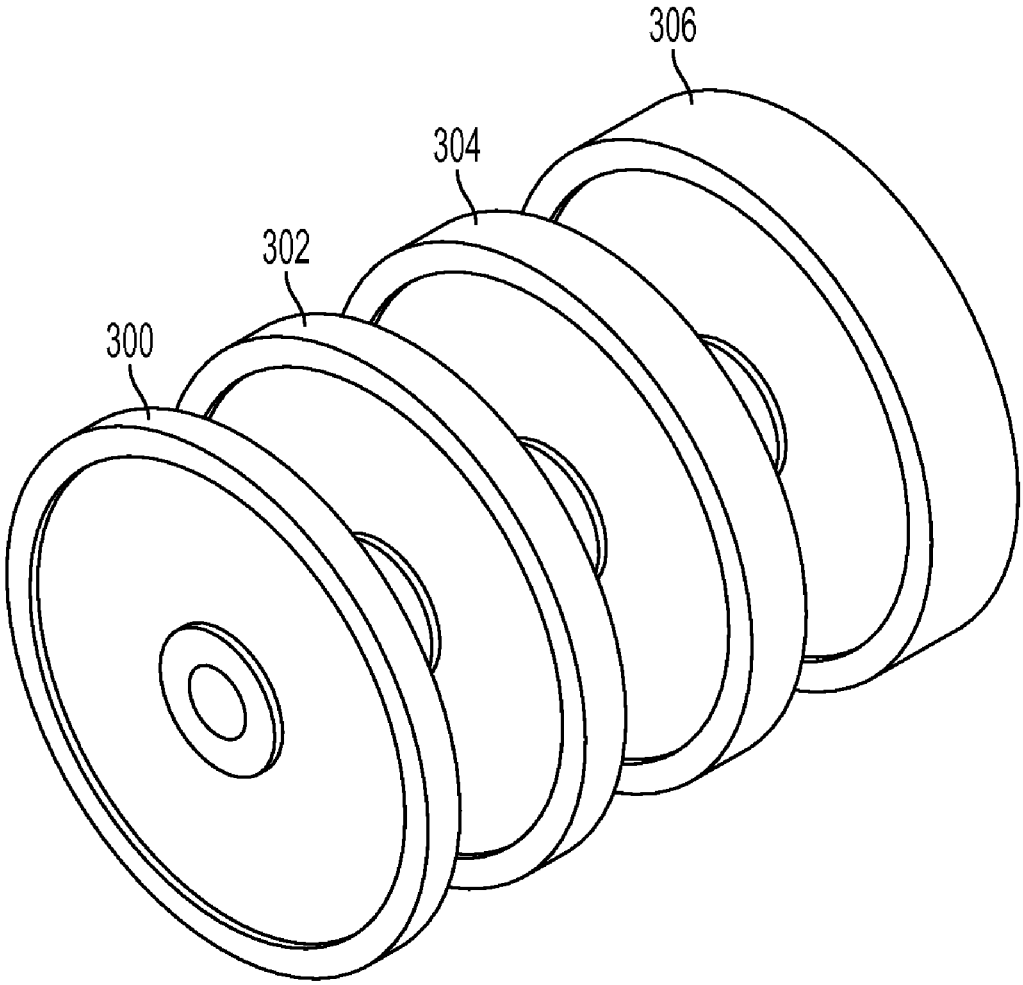
FIG. 6 is a diagram showing various technique plates in accordance to one embodiment.
Figure 7:
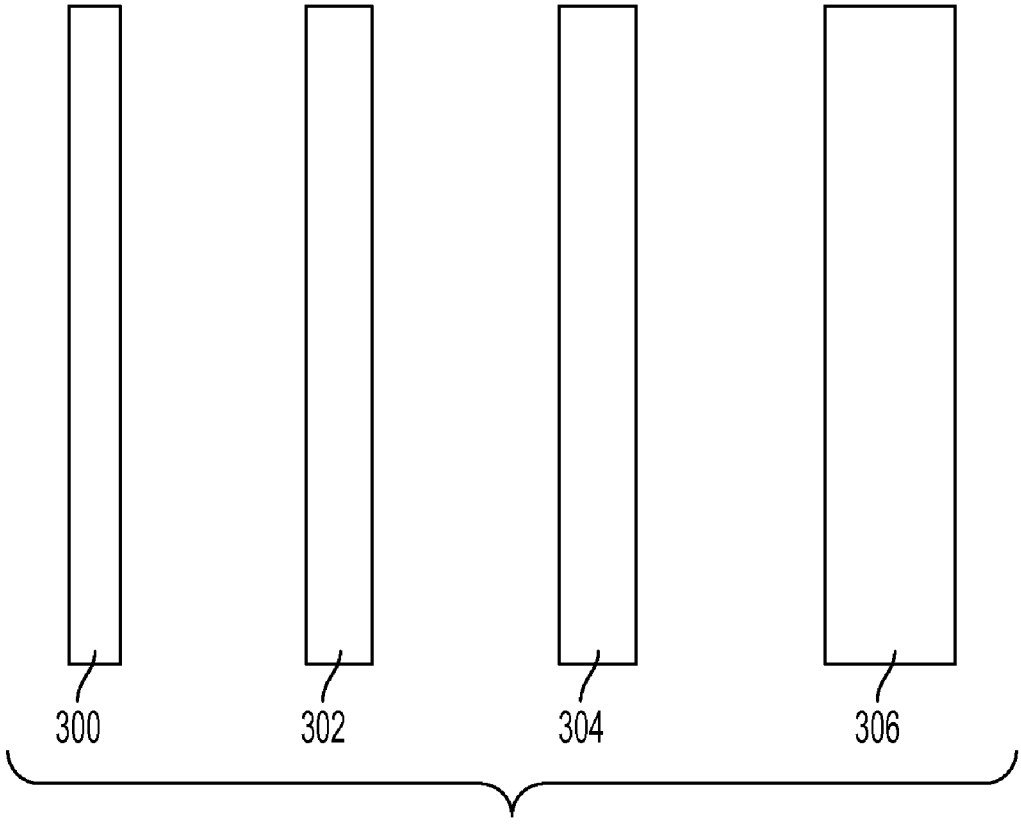
FIG. 7 is a side-view diagram of the technique plates in accordance to one embodiment.

FIG. 6 is a perspective-view diagram showing various technique plates 300, 302, 304, and 306 in accordance to one embodiment. FIG. 7 is a side-view diagram of the technique plates 300, 302, 304, and 306 in accordance to one embodiment. FIGS. 6 and 7 show plates, each having a different weight. In one embodiment, the plates have the same diameter regardless of weight. In one embodiment, each weight has a different color. In one embodiment, each technique plate ranges from 2.5 kilograms to 10 kilograms, where the thickness increases with weight. For example, technique plate 300 weighs 2.5 kilograms, technique plate 302 weighs 5 kilograms, technique plate 304 weighs 7.5 kilograms, technique plate 306 weighs 10 kilograms. In particular embodiments, the technique plates 300-306 are available in both pounds (e.g., USA) and kilograms (international), so as to be convenient for weightlifters and to be compatible with the style of the weight room. In one embodiment, each technique plate 300-306 is 17½ inches in diameter, regardless of weight. In one embodiment, each technique plate 300-306 has a 2 inch center hole. In one embodiment, the technique plates fit all Olympic and competition bars.

Referring again to FIG. 3, at the novice level of weightlifting, the intensity used is low and the mass (e.g., weight) of the technique plates 102 are light. In one embodiment, as indicated above, the technique plates are the same size and shape as plates used for weightlifting competition. In a specific embodiment, the technique plates are the same size and shape as plates used for Olympic weightlifting competition. Technique plates are particularly helpful for a beginner weightlifter, as higher-level lifters have little or no need for them.

In one embodiment, the technique plates are lighter in mass and in weight than conventional weightlifting plates. Conventional weightlifting plates are not only heavier than the technique plates 102, but conventional weightlifting plates are also not available in the same combination of weight (range), diameter size, and hole size as the technique plates 102. For example, conventional plates (also referred to as fractional plates) occur in the 2.5 kilograms to 10 kilograms range, but conventional plates do not exist in this range with a 17½ inch diameter. In particular embodiments, a plate of this dimension determine the starting height of the bar in competition. Because all of the technique plates have the 17½ inch diameter, the starting height of the bar is the same.

In one embodiment, each technique plate 102 is formed from a single piece of a plastic-based composite and molded by compression in special castings to meet a specific mass and shape for use with an Olympic lifting bar. In one embodiment, the special casting is designed in such a way to allow a single casting to be used for all sizes (or weights) of plate. In one embodiment, the special casting includes a negative mold of the technique plate. In one embodiment, the primary geometric difference between the different size technique plates, for achieving the different assigned weights of the technique plates, is the thickness each of the technique plates. In one embodiment, the thickness of the special casting may be adjusted to allow the thickness of the mold to be adjusted. This enables the formation of different size technique plates using the same mold. In other words, a single mold may be used to form all size technique plates.

As indicated above, in one embodiment, each of the technique plates 102 is formed from a single solid piece of compressed plastic. Because compressed plastic composite is very strong, a given technique plate 102 will not break apart, as there are no dissimilar materials other than the plastic composite. In one embodiment, plastic composite is composed of recycled plastics. In one embodiment, the technique plates have no toxins or recycled rubber odors. As such, the technique plates 102 are environmentally friendly.

In one embodiment, the technique plates 102 are rugged due to several structural characteristics. For example, as indicated above, in one embodiment, each technique plate 102 is formed from a single solid piece of compressed plastic. Having no dissimilar materials, the technique plates 102 will not come apart from impact when dropped on the ground. Furthermore, in one embodiment, technique plates 102 being made from compressed plastic makes the technique plates 102 very hard, and very difficult to break. In one embodiment, the ruggedness of the technique plate 102 make them very difficult to break even when fractional plates are added to them for progressive loading. The lower density allows more plastic to be used and still result in a light weight plate. Because of the lower density, the technique plates that are bigger in size are lighter than they appear. The result is a wider plate that does not teeter on the floor, and the fit at the hub does not allow the plate to wobble against the bar. As a result, a coach and weightlifter can focus on technique and not worry about damage from impact when the technique plates are dropped to the ground.

Figure 8:
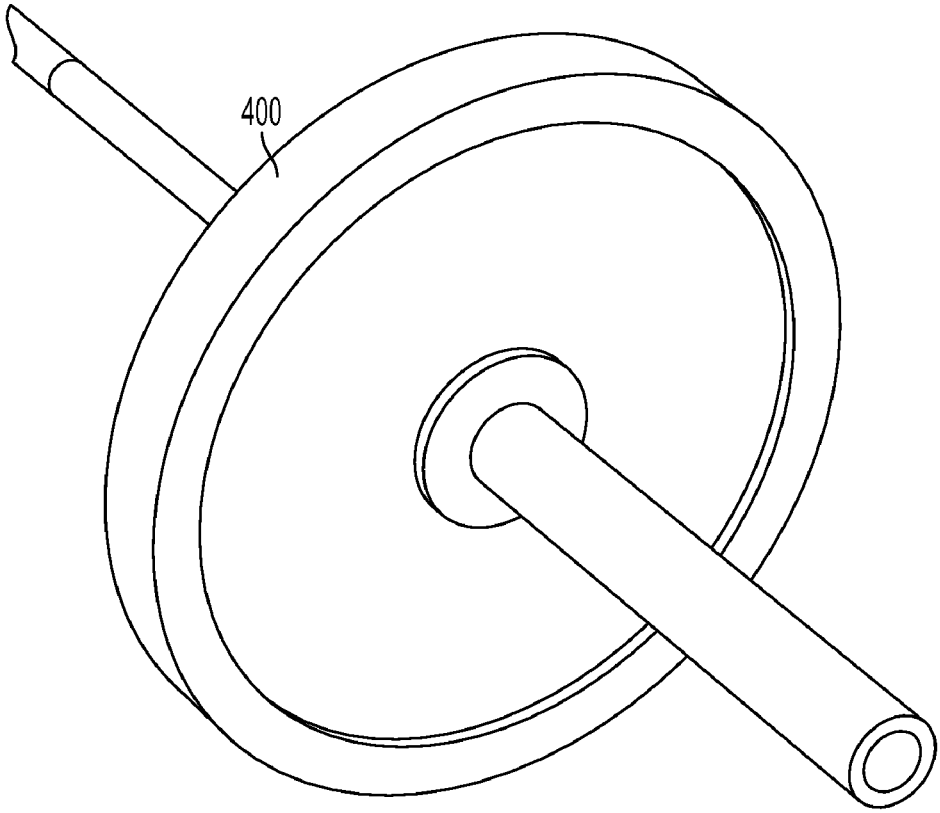
FIG. 8 is a diagram of a technique plate in accordance to one embodiment.

Because plastic composite is solid and rugged, the technique plates 102 will not become discolored from being use, thereby eliminating any need for painting. In one embodiment, the technique plates 102 have a chalky, speckled, or peppered appearance from the plastic composite mixture. FIG. 8 is a diagram of a technique plate 400 having a speckled appearance in accordance to one embodiment. This facilitates in distinguishing the technique plates 102 (FIG. 3) from conventional plates. It simplifies use in plate selection and verification of balanced bar loading. In one embodiment, the technique plates 102 include private/custom labeling to further distinguish them from conventional plates. In one embodiment, the technique plates 102 never need painting because of their chalky appearance. This makes the technique plates 102 look the same over time no matter how often they are used.

In one embodiment, the technique plates 102 have different colors depending on their weights. In one embodiment, the color is provided by the plastic-composite, and the plastic-composite enables the technique plates 102 to still be marbled, speckled, or chalky.

In one embodiment, because each technique plate 102 is made from compressed plastic, the technique plates 102 do not rust as metal plates do. As indicated above, each technique plate 102 is made of a single solid piece of plastic. Having no metal center (hub) prevents damage to the technique plate 102 and to the bar when the bar is dropped, which often occurs with metal hubs.

The one-piece construction of the technique plates 102 also eliminates problems such as stiction. Stiction may be defined as friction when two metals slide against each other that are associated with a metal hub around the center hole. The one-piece construction combined with the strength of the plastic composite also makes the hole (hub) of the technique plate 102 rugged.

Furthermore, in one embodiment, the technique plates 102 slide on and off the bar smoothly. Plastic by nature slides easily against the metal bar 104. As such, the technique plates 102 slide easily on and off the bar 104. In one embodiment, the center hub or boss of the technique plates 102, where the hole is located, is larger than the maximum thickness of the technique plate 102. This provides the widest load bearing surface area between the plastic of the technique plate 102 and the bar 104. This minimizes the wobbling and distributes the force and impact between the bar 104 and technique plate 102 from the action of lifting evenly throughout the thickness of the technique plate 102 across the depth of the hole. In one embodiment, the tolerance of the hole in the technique plate 102 is specified to allow for easy sliding the technique plate 102 on and off the bar 104 and use while lifting.

Figure 1:
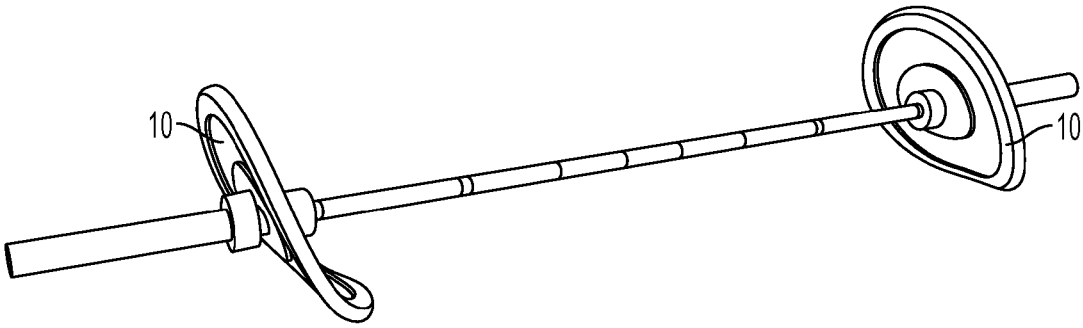
FIG. 1 is a diagram of a conventional technique plates.
Figure 2:
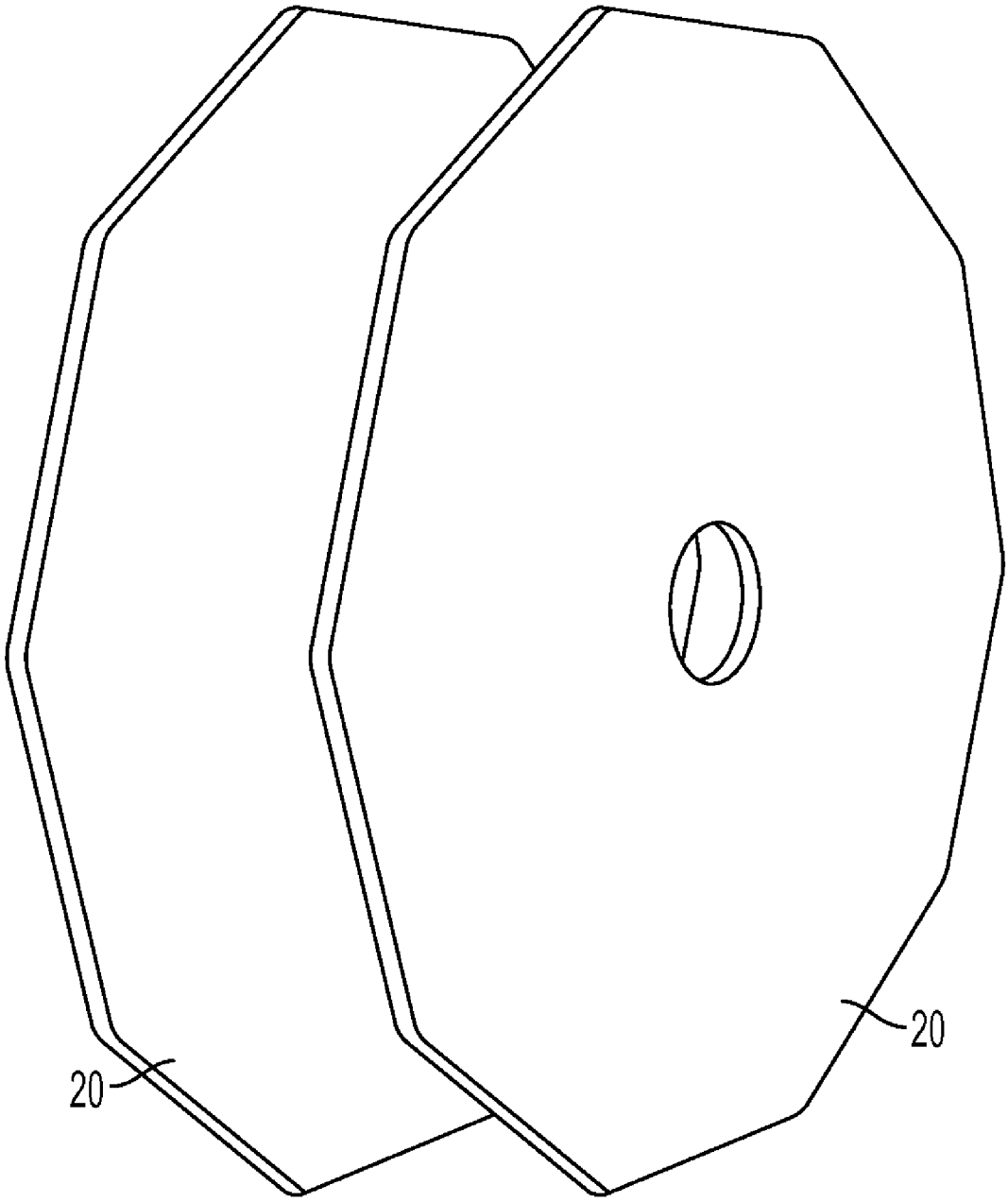
FIG. 2 is a diagram of conventional technique plates.

In one embodiment, the hub or center hole of each technique plate 102 has a tolerance that fits closely to the bar to help eliminate wobble and bowing of the technique plate 102 when on the bar, and to eliminate slipping around when the bar is dropped. For example, to further prevent wobble, each technique plate 102 has a sufficient depth or thickness, wide enough to eliminate wobble and bowing of the technique plate 102 when on the bar 104. A hole that is too large would allow teetering of the technique plate 102 on the bar during lifts. Embodiments prevent this teetering, as the combination of the hole tolerance and the hole width is adjusted to maintain easy sliding with minimum teetering of the technique plate 102 on the bar 104. In one embodiment, the bar sits up evenly for the start of lift training (i.e., the bar is level relative to the ground). Referring again to FIG. 1, when one plate is bent or teetering, poor training technique is developed. The technique plates of the present invention prevent such poor technique and help to develop proper technique. At the beginner or novice level, weightlifting training requires high volume (e.g., many repetitions). As such, ease of placing and removing the technique plates 102 on and off the bar 104 application facilitates use and learning.

In one embodiment, the technique plates 102 are formed into competition sizes and shapes. For example, in one embodiment, each technique plate 102 may be formed with a 17½ inch diameter and with a 2 inch diameter center hole, which would fit all Olympic bars.

Because of the ruggedness of the technique plates 102 and their being secure when on the bar 104, a coach and weightlifter can better focus on technique without worrying about damaging the plates from being dropped on the floor. A coach and athlete can appreciate this aspect especially in the learning phase or technique phase of learning the sport of weightlifting.

Other benefits of the technique plates 102 is that they are easy to use and are overall less costly (being made from plastic) than conventional weightlifting plates.

According to the system and method disclosed herein, the present invention provides numerous benefits. For example, embodiments of the present invention provide a rugged, solid technique plate. Embodiments of the present invention also provide a technique plate that fits all Olympic bars. Also, using the costs of composite materials and processes associated with composite materials keeps costs lower than other manufactured technique plates.

A technique plate has been disclosed. The technique plate is a plate formed as one piece and includes a hole that is configured to receive a bar. The technique plate is used in a weightlifting system. According to the apparatus disclosed herein, the technique plate is rugged and stable enough be used with other fractional plates for progressive loading.

The present invention has been described in accordance with the embodiments shown. One of ordinary skill in the art will readily recognize that there could be variations to the embodiments, and that any variations would be within the spirit and scope of the present invention. Accordingly, many modifications may be made by one of ordinary skill in the art without departing from the spirit and scope of the appended claims.

What is claimed is:

1. A weightlifting apparatus that is usable to engage in exercise activities comprising:

a bar weighing 20 kilograms;

a technique plate comprising:

a weight amount that is not greater than 2.5 kilograms;

a circular configuration having a diameter of at least 17.5 inches;

a portion that encircles a bar-receiving hole near a center of the circular configuration, wherein the portion includes a thickness that minimizes wobbling of the technique plate when the technique plate is positioned on the bar weighing 20 kilograms; and a single-piece construction including a compressed plastic-based composite, wherein the compressed plastic-based composite includes a density level, which causes the technique plate to possess a combination of characteristics that include the weight amount not greater than 2.5 kilograms, the diameter of 17.5 inches, and the thickness that minimizes wobbling, and wherein, when the technique plate is positioned on the bar weighing 20 kilograms and the bar is dropped from at least a shoulder-level height of a user, such that the technique plate strikes a floor, the technique plate is not damaged.

2. The technique plate of claim 1, wherein the single-piece construction includes no more than one composite compound that is used to form a structure of the technique plate.

3. The technique plate of claim 1, wherein the single-piece construction does not include a metal ring near the portion.

4. The technique plate of claim 1, wherein the portion includes a hub surrounding the bar-receiving hole and wherein the hub is comprised of the compressed plastic-based composite.

5. The technique plate of claim 1, wherein the plastic-based composite includes a recycled-plastic-based composite.

6. A weightlifting technique plate that is usable to engage in exercise activities, the technique plate comprising:

a weight amount that is not greater than 2.5 kilograms;

a circular configuration having a diameter of 17.5 inches;

a portion that encircles a bar-receiving hole near a center of the circular configuration, wherein the portion includes a hub having a thickness that minimizes wobbling of the technique plate when the technique plate is positioned on a bar; and a single-piece construction including a compressed plastic-based composite, wherein a density level of the compressed plastic-based composite causes the technique plate to possess a combination of characteristics that include the weight amount not greater than 2.5 kilograms, the diameter of 17.5 inches, and the thickness that minimizes wobbling and wherein the combination of characteristics ensures that the technique plate is not damaged when dropped from at least a shoulder level height of a user.

7. The technique plate of claim 6, wherein the single-piece construction includes no more than one composite compound that is used to form a structure of the technique plate.

8. The technique plate of claim 6, wherein the plastic-based composite includes a recycled-plastic-based composite.

9. The technique plate of claim 6, wherein the hub does not include any metal ring.

* * * * *